United States Patent [19]

Inoh

[11] Patent Number: 4,707,007

[45] Date of Patent: Nov. 17, 1987

[54] STRIKER MEANS FOR AUTOMOTIVE DOOR LATCH ASSEMBLY

[75] Inventor: Isamu Inoh, Tokyo, Japan

[73] Assignee: Honda Giken Kogyo Kabushiki Kaisha, Tokyo, Japan

[21] Appl. No.: 827,788

[22] Filed: Feb. 6, 1986

[30] Foreign Application Priority Data

| | | | |
|---|---|---|---|
| Feb. 7, 1985 | [JP] | Japan | 60-022498 |
| Feb. 7, 1985 | [JP] | Japan | 60-016348[U] |
| Feb. 7, 1985 | [JP] | Japan | 60-016349[U] |
| Feb. 7, 1985 | [JP] | Japan | 60-016350[U] |
| Feb. 26, 1985 | [JP] | Japan | 60-027984[U] |

[51] Int. Cl.[4] ..... E05C 21/02

[52] U.S. Cl. ..... 292/341.16; 292/216; 292/341.18

[58] Field of Search ..... 292/341.16, 341.18, 292/216

[56] References Cited

U.S. PATENT DOCUMENTS

| | | | |
|---|---|---|---|
| 748,202 | 12/1903 | Mills | 292/140 X |
| 2,403,182 | 7/1946 | Leary et al. | 292/341.18 |
| 2,903,288 | 9/1959 | Joachim et al. | 292/341.16 |
| 2,994,550 | 8/1961 | White | 292/341.16 |
| 3,403,934 | 10/1968 | Butts | 292/341.16 |
| 3,835,678 | 9/1974 | Meyer et al. | 292/341.16 X |
| 4,113,293 | 9/1978 | Paquette | 292/341.18 |

*Primary Examiner*—Alfred C. Perham
*Attorney, Agent, or Firm*—Lyon & Lyon

[57] ABSTRACT

To eliminate the need for forcibly closing the door to achieve a full closure of an automotive door, the striker which cooperates with the latch assembly of the door is not only allowed to move outwardly from its normal position but also adapted to be positively driven back to the normal position by a drive means. When the door is to be closed from its open position, since the striker has been displaced outwardly from its normal position, latching of the latch assembly with the striker is easily achieved by hand even when the reaction force of a weather strip is substantial. Then, the striker is positively driven inwardly to its normal position by the drive means against the reaction force of the weather strip. By appropriately controlling the drive means, very little force will be required to achieve the latching of the latch assembly with the striker and the complete closure of the door will be achieved by the drive means which may be an electric motor.

24 Claims, 6 Drawing Figures

STRIKER MEANS FOR AUTOMOTIVE DOOR LATCH ASSEMBLY

TECHNICAL FIELD

This invention relates to an automotive door latch assembly and in particular to an improvement of a striker means therefor.

BACKGROUND OF THE INVENTION

For the purpose of preventing the intrusion of rain water and so on, a seal member, which is molded typically from synthetic rubber and is generally called weather strip, is interposed in a gap between a door and a vehicle body. Recently, with the aim of reducing the wind noise and noises from air leakage in addition to improving the sealing effect, weather strips of higher reaction force or, in other words, weather strips having higher elastic coefficients are being preferred. And, this high reaction force tends to prevent a full latching of the door latch upon closing of the door and may cause an only partially closed state of the door. Therefore, it is sometimes necessary to forcibly close the door to overcome the reaction force of the weather strip and to obtain a fully latched state of the door latch. However, when the door is forcibly closed, the sound thereof and the resulting sudden change in the cabin pressure may cause discomfort to the passenger.

To resolve such a problem, it is conceivable to move a striker, by a suitable means, which is mounted to the door to engage with a latch assembly mounted to the door to keep the door closed. Specifically, the striker may be placed at an outwardly position in advance so as to achieve a latching before the reaction force of the weather strip starts acting upon the door and, after the door latch assembly is fully latched to the striker, the striker is positively driven to a position which causes complete deformation of the weather strip for sufficient sealing effect and complete closure of the door.

However, in order to pull in the striker from its latched position against the reaction force of the weather strip, a substantially strong force is necessary and it is difficult to install, in the limited space in the interior of the body panel, a drive means which can drive the striker. It will be even more difficult to install such a drive device in the center pillar of a four-door passenger car.

Furthermore, in view of the fact that a substantially strong force is necessary to fully close the door and to maintain the door closed, the mechanical strength of the striker must be sufficiently high for maximum safety. Therefore, the striker is preferred to be made of high tensile strength steel. As a result, friction and impact sounds may be produced from metallic contacts during the action of the striker and it may give discomfort to the passenger. Furthermore, in order to drive the striker from the interior of the body panel, it is necessary to form an opening in the body panel adjacent to the moving part of the striker and, if it allows intrusion of rain water or dust, the interior of the door panel may be corroded causing ill effect to the drive means and the body panel itself.

Additionally, in designing such a power assisted automotive door, the cost of manufacture must be minimized and fail safe features must be incorporated from practical view points. For instance, if an attempt is made to drive the striker for instance with an electric motor, an electric switch therefor will be necessary and the labor and the cost necessary for manufacture thereof will increase. If a manual switch is installed near an instrument panel, not only the feeling of the vehicle handling may be impaired but also the equipment will be wasted if the user forgets to use it. And the device must work properly even when the user is not aware of its action.

SUMMARY OF THE INVENTION

In view of such considerations and the problems of the prior art, a primary object of the present invention is to provided a striker means for automotive door latch assembly according to which the door needs not be forcibly closed to assure full closure of the door.

Another object of the present invention is to provided a compact and simple striker means for automotive door latch assembly which can assure secure latching of the door without requiring excessive door closing force.

Yet another object of the present invention is to provided a compact and simple striker means for automotive door latch assembly which will not allow intrusion of rain water and so on inside the body panel and will not produce uncomfortable metallic noises.

Yet another object of the present invention is to provided a striker means for automotive door latch assembly which can be manufactured economically without unduly increasing the manufacturing steps and, yet, which can achieve a reliable latching.

According to the present invention, such objects are accomplished by providing a striker means for automotive door latch assembly, comprising: a latch member mounted to a jamb surface of a door; and a striker member mounted to an opposing surface of a vehicle body, which opposes the jamb surface of the door when the door is closed, for engagement with the latch member, further comprising: a guide means for guiding the striker member for motion along a closing direction of the door, and a drive means for driving the striker member along the closing direction of the door when the latch member has been engaged with the striker member.

Thus, by allowing the striker, which is provided on the vehicle body for engagement with the latch member provided on the door of the vehicle, to be driven by external power along the door closing direction, the latch member may be fully engaged with the striker before the weather strip is deformed, and the striker may be forced towards the interior of the passenger compartment by the external power to achieve the complete closure of the door.

According to a certain aspect of the present invention, the guide means comprises a horizontal slot provided in a base plate which is fixedly attached to the opposing surface of the vehicle body opposing the jamb surface of the door when the door is closed, and the drive means comprises a drive source, a cam fixed to an output shaft of the drive source, a cam follower fixed to a base end of the striker member for cooperation with the cam.

Thus, by using a cam having an appropriate profile as a means for driving the striker member mounted to the vehicle body for engagement with the latch member of the vehicle door, the striker member can be moved until the weather strip is completely deformed requiring only a small driving force, thus allowing the striker means to be made compact. In particular, if a cam having a pair of lobes which are 90 degrees apart is used, the striker can be moved over a certain distance by a small angular displacement of the cam and the time required for the action of the striker means can be advantageously reduced.

According to another aspect of the present invention, the reduction gear device may consist of a worm gear device. By using a worm reduction gear device as a means for moving the striker member which is provided on the vehicle body for engagement with the latch member of the door, the input shaft and the output shaft thereof can be oriented orthogonal to each other and the device can be made compact. If there is not enough room in the door panel to install a striker assembly, a flexible means may be used to transmit a drive force to the latch assembly from a motor which may be located far away from the striker means.

According to yet another aspect of the present invention, the opposing surface of the vehicle body is provided with an opening which is wide enough to accommodate at least a main part of the drive source, the cam and the cam follower, and is substantially covered by the base plate, whereby the base plate is interposed between a base end of the striker member and the periphery of the opening of the opposing surface of the vehicle body.

Thereby the striker means may be built as an assembly which can be readily installed inside the door panel from outside and the cost and labor involved in manufacture thereof will be reduced. Further, by inserting a seal member in the sliding surface between the base end of the striker member and the base plate, not only the intrusion of dust and moisture into the body panel is prevented but also the metallic noise which may arise from metal to metal contact can be prevented.

According to yet another aspect of the present invention, the drive means which may include an electric motor may be conveniently controlled with a door switch which may also serve as a switch for turning on a room lamp.

BRIEF DESCRIPTION OF THE DRAWINGS

The present invention will now be shown and described in the following in terms of concrete embodiments thereof with reference to the appended drawings, in which.

DETAILED DESCRIPTION OF THE PREFERRED EMBODIMENTS

Now preferred embodiments of the present invention are described in the following with reference to the appended drawings.

Figure 1:
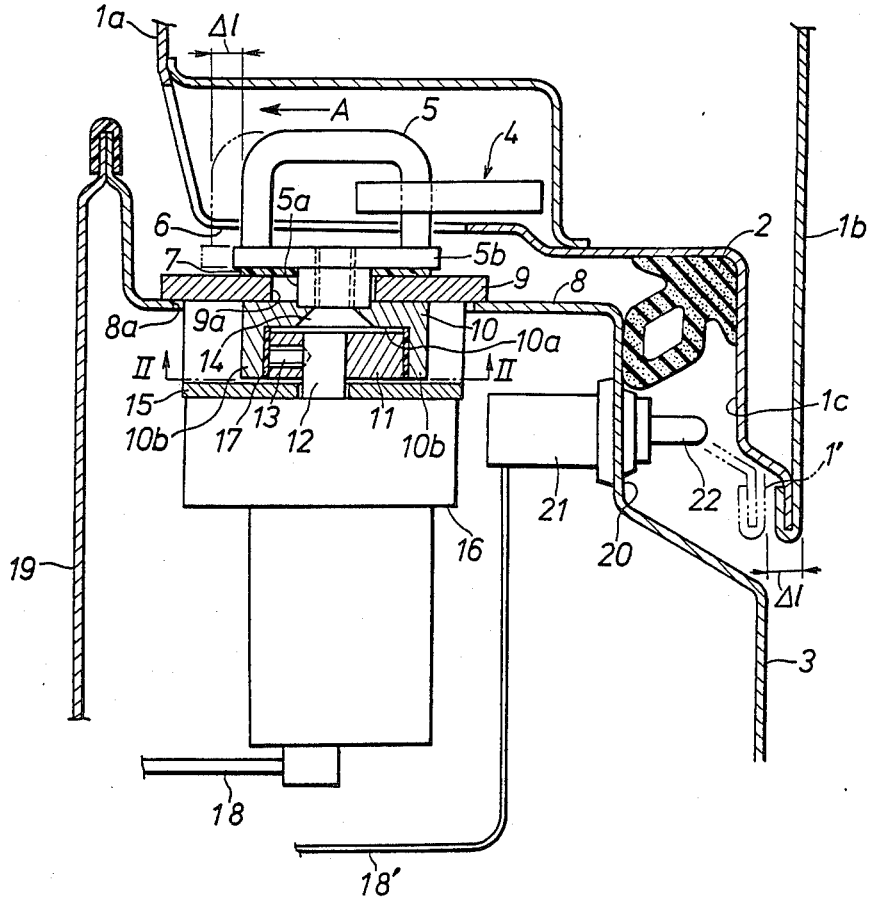
FIG. 1 is a sectional plan view of an embodiment of the striker means of the present invention.

In FIG. 1, a latch assembly 4 is installed in the interior of jamb face or the rear end surface 6 of a door formed by bending a door inner panel 1*a* towards a door outer panel 1*b* although only the working end of the latch assembly 4 is shown in the drawing. And, a striker 5 having a C-shaped working end is mounted, by way of a base plate 9, to a front end surface 8 of a center pillar or a rear pillar forming a part of a body outer panel 3 to maintain the closed state of the door by engaging with the latch assembly 4. A weather strip 2 is fitted to a corner portion of the door rear end surface 6 in such a manner that the weather strip 2 elastically engages with the body outer panel 3 for sealing the passenger compartment from outside when the door is closed.

A boss 5*a* of a rectangular cross-section is formed in a base portion 5*b* of the striker 5 so as to project towards the interior of the body panel 3 and is passed into a guide opening 9*a* of a horizontally elongated rectangular shape formed at a substantially central part of a base plate 9 which is fixedly secured to the body panel 3 for instance by screws. Further, a cam follower 10, which is formed by bending two side ends 10*b* of a rectangular plate towards the interior of.the body panel 3 and defines a rectangular depression 10*a*, is fixedly secured to the free end of the boss 5*a* which passes through the guide opening 9*a* of the base plate 9 towards the front end surface 8 of the vehicle body by means of a countersunk bolt 14. Thereby, the cam follower 10 and the striker 5 are prevented from coming off along the longitudinal direction thereof, and are integrally moveable in the range defined by the contact of the boss 5*a* with the lateral ends of the guide opening 9*a* along the lateral direction.

A seal member 7, for instance made of synthetic resin having a relatively small friction coefficient, such as fluoride resin, is interposed between the base plate 9 and the base portion 5*b* of the striker 5, so as to prevent the intrusion of dust and moisture into the body panel on one hand and to reduce the frictional resistance when the striker 5 is driven horizontally.

The cam follower 10 defines a pair of opposing internal walls which rise perpendicularly relative to the sliding direction with its lateral end portions 10*b*, to accommodate a cam, which is described hereinafter, therein. Lining 17 made of lubricating synthetic resin is adhered to these internal walls.

Figure 2A:
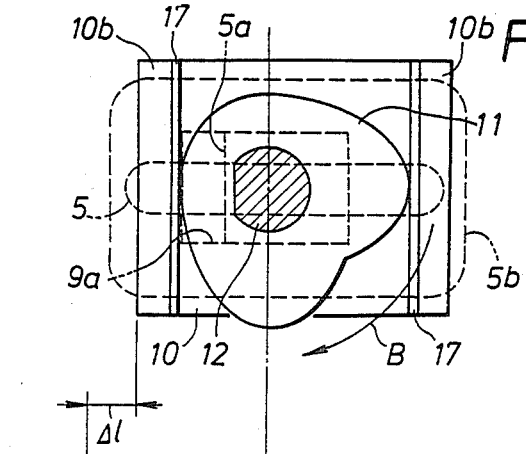
FIG. 2*a* is a view as seen across line II—II of FIG. 1 to show the orientation of the cam in the initial stage of closing the door.
Figure 2B:
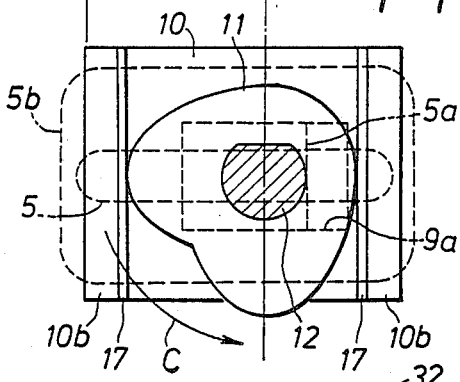
FIG. 2*b* is a view similar to FIG. 2*a* showing the orientation of the cam when the door is fully closed.

Further, a motor 16 having internal reduction gears and lead wires 18 for power supply is mounted to the interior of the body outer panel 3 by means of mounting bolts with are not shown in the drawings by way of a mounting bracket 15 with its drive shaft 12 directed to the front direction of the vehicle. A cam 11 is integrally fixed to the free end of the drive shaft 12 by means of a set screw 13, and the cam 11 is accommodated in the depression 10*a* of the cam follower 10. The cam 11 is substantially heart-shaped by combining a pair of oval cams by their diametral lines, as best shown in FIGS. 2*a* and 2*b*.

In assembling such a structure, first, after the motor 16 with the reduction gears is mounted to the bracket 15, the cam 11 is fixed to the drive shaft 12 protruding from the bracket 15 by the set screw 13, and the cam follower 10 is securely attached to the striker 5 by the countersunk bolt 14 after interposing the base plate 9 therebetween. And, with the cam follower 10 engaged with the cam 11, the bracket 15 is attached to the base plate 9 by means of bolts which are not shown in the drawings, and the whole assembly is mounted to the front end surface 8 of the pillar by way of the base plate 9. Thereby, the motor 16 having the reduction gears and fitted with the cam 11 is inserted into the interior of the body panel defined by the body outer panel 3 and a body inner panel 19 from an opening 8*a* formed in the front end surface 8 of the pillar, and only the base plate 9 and the striker 5 are exposed to the exterior.

A door switch 21 is fixedly secured to a suitable place in a side surface 20 which is bent from the body outer panel 3 so as to face laterally of the vehicle and connects to the front end surface 8 of the pillar. A plunger 22 projects outwardly from this door switch 21, outwardly biased by a spring which is not shown in the drawings, and the door switch 21 incorporates therein contacts which open when the plunger 22 is depressed by contacting an inner surface 1*c* of the door panel as will be described in greater detail hereinafter. Numeral 18' denotes lead wires for the door switch 21.

Figure 3:
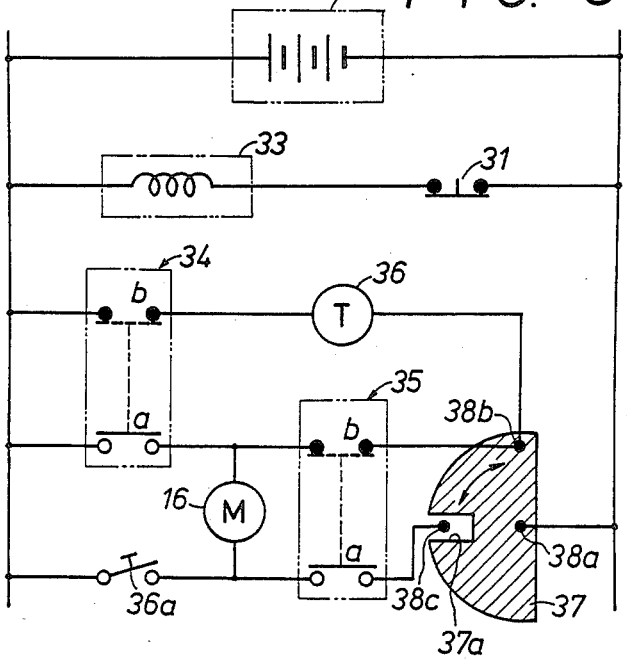
FIG. 3 is a circuit diagram of an electric circuit for controlling the drive motor.

FIG. 3 is a circuit diagram showing an electric circuit for the above embodiment. Internal contacts 31 of the door switch 21 are so-called normally-closed contacts which close when the door is opened, and, therefore, energize a relay coil 33 of a relay unit 34 and 35 with electric current supplied from a power source 32 when the door is open. The relay unit incorporates two sets of contacts 34 and 35, and these contact sets include normally-open contacts 34*a* and 35*a* and normally-closed contacts 34*b* and 35*b*.

Furthermore, a rotary contact piece 37, which is semi-circular in shape and has a notch 37*a* in the middle part of the outer circumference thereof, is fixedly secured to the drive shaft 12 of the motor 16 so as to integrally rotate with the cam 11. A common contact 38*a* is always in contact with the rotary contact piece 37 and is also connected to the negative pole of the power source 32. The rotary contact piece 37 further comprises a pair of contacts 38*b* and 38*c* which are angularly spaced to each other by 90 degrees. The second contact 38*c* aligns with the notch 37*a* and only the first contact 38*b* is in contact with the common contact 38*a* when the cam 11 is in the door open position as shown in FIGS. 2*a* and 3, and, conversely, the first contact 38*b* aligns with the notch 37*a* and only the second contact 38*c* is in contact with the common contact 38*a* when the cam 11 is in the door close position as shown in FIG. 2*b*.

The normally-closed contacts 34*b* of the first contact set 34 of the relay unit are connected to the positive pole of the power source 32 at their one end and to the first contact 38*b* of the rotary contact piece at their other end by way of a timer 36. Contacts 36*a* of the timer 36 are normally-open contacts so that they close after a certain time interval, for instance five seconds, upon energization of the timer 36 and open at the same time as the timer 36 is deenergized. These contacts 36*a* are connected to the positive pole of the power source 32 at their one end and to the second contact 38*c* of the rotary contact piece 37 at their other end by way of the normally-open contacts 35*a* of the second contact set 35 of the relay unit.

Further, the normally-open contacts 34*a* of the first contact set 34 of the relay unit are connected to the positive pole of the power source 32 at their one end and to the first contact 38*b* of the rotary contact piece 37 at their other end by way of the normally-closed contacts 35*b* of the second contact set 35 of the relay unit. The motor 16 is connected between the node between the normally-open contacts 34*a* of the first contact set 34 of the relay unit and the normally-closed contacts 35*b* of the second contact set 35 of the relay unit and the node between the contacts 36*a* of the timer 36 and the normally-open contacts 35*a* of the second contact set 35 of the relay unit.

Now the action of the above-described embodiment is described in the following particularly with reference to FIGS. 1 to 3.

The orientation of the cam 11 is so defined that the striker 5 is located to the right in FIG. 1 or to the outside of the vehicle body when the door is open (FIG. 2*a*). When the door is closed by hand in this state, since the striker 5 is located towards the outside of the vehicle body, the latch assembly 4 and the striker 5 are engaged and fully latched to each other before the weather strip 2 is deformed by the pressure between the door and the vehicle body. In this state, the weather strip 2 may only lightly touch the vehicle body and the air tightness of the passenger compartment may not be complete. And, there is a gap delta 1 between the door outer panel 1*b* and the body outer panel 3 and, even though it appears that the door is only partially closed, the latch assembly 4 is fully latched. Since the reaction force of the weather strip 2 is yet to be fully active, the force required to achieve such a closed state by hand may be extremely small.

When the plunger 22 of the door switch 21 is pushed into the door switch 21 as a result of the partially closed state of the door upon engagement of the latch assembly 4 with the striker 5, the contacts 31 of the door switch 21 are opened and the relay coil 33 is deenerzized. Then, since the timer 36 is activated by the closure of the normally-closed contacts 34*b* and the normally-closed contacts 35*b* are closed at the same time, after a certain time interval, for instance five seconds, the timer contacts 36*a* are closed and a closed circuit is formed which rotates the motor 16 in the direction to pull the striker 5 inwardly or in the direction indicated by an arrow B in FIG. 2*a* by engagement between the cam 11 and the cam follower 10. As a result of the rotation of the cam 11 due to such rotation of the motor 16, the cam follower 10, along with the striker 5, is positively slid along the guide opening 9*a* in the direction indicated by an arrow A in FIG. 1 or towards the passenger compartment.

When the cam 11 has turned to the position shown in FIG. 2*b*, the notch 37*a* of the rotary contact piece 37, which integrally rotates with the cam 11 and is incorporated in the reduction gear, aligns with the first contact 38*b* associated therewith, and both the motor 16 and the timer 36 are deenergized at the same time. At this moment, the door has been pulled in to the position indicated by numeral 1' in FIG. 1, and the weather strip 2 is fully compressed to bring about the air tight state of the passenger compartment.

When the door is opened and the door switch 31 is closed, the relay coil 33 is energized and the normally-open contacts 34*a* and 35*a* are both closed. As a result, the motor 16 is rotated in reverse and the striker 5 is displaced outwardly from the vehicle body again by engagement of the cam 11 and the cam follower 10. Accordingly, when the cam 11 as well as the rotary contact piece 37 has been rotated to the position shown in FIG. 2*a*, the notch 37*a* aligns with the second contact 38*c*, as shown in FIG. 3, and the motor 16 stops.

Thus, because the door closing action is based on a timer action, incomplete latching is avoided even when the door switch 21 is prematurely closed prior to the engagement of the latch assembly and the striker. This simplifies the adjustment of the action of the door switch 21. Additionally, since the motor 16 will not start acting abruptly, it is possible to remove a foreign matter which might otherwise be held between the door and the vehicle body. Furthermore, since the door switch 21 is closed when the door is closed, no electric power will be wasted throughout the time the door is closed. And, it is possible to build the circuit as a compact unit which fits into the device for driving the striker.

Although the deactivation of the motor was controlled by the opening of the rotary contact piece 37 which rotates integrally with the cam 11 in the above embodiment, it is possible to replace it, for instance, with normally-closed contacts of a limit switch, and it is also possible to define the extent of the motion of the striker with a mechanical stopper and to terminate the action of the motor with a timer after the transmission of rotative power between the motor and the cam is disconnected with a slip clutch.

Figure 4:
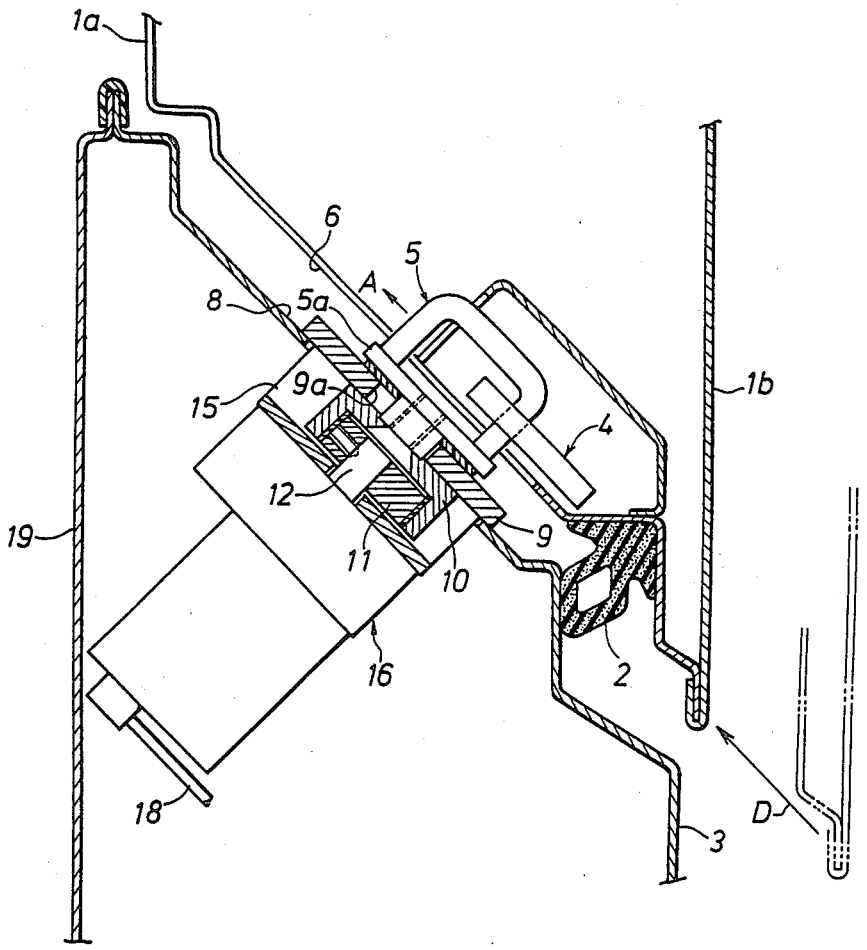
FIG. 4 is a sectional plan view, similar to FIG. 1, showing a second embodiment of the striker means according to the present invention which is applied to a sliding automotive door.

The above embodiment pertained to a normal hinge type automotive door, but the invention is equally applicable to a sliding door. FIG. 4 shows another embodiment of the present invention applied to a sliding door. In FIG. 4, the parts corresponding to those in FIG. 1 are denoted by like numerals.

As opposed to a hinge door which undergoes an arcuate motion about a hinge axis, a sliding door involves both a translational lateral motion relative to the vehicle body and a longitudinal motion along the vehicle body as it opens and closes. In other words, a sliding door is closed and opened by being slid over a guide rail, which is not shown in the drawings, provided on the vehicle body.

In the slide door shown in FIG. 4, after the whole door has been translated in parallel orientation towards obliquely rearward direction until the door inner panel 1*a* and the body outer panel 3 do not interfere each other, the door is opened by being slid backwardly along the body outer panel. Therefore, the rear end surface 6 of the door and the front end surface 8 of the pillar define a matching surface which extends obliquely in relation with the longitudinal direction, but this embodiment is not different from the hinge door in that the door is maintained in the closed state by the engagement of the latch assembly 4 provided on the door and the striker 5 provided on the vehicle body. Therefore, it suffices if the device is arranged along the direction of the motion of the door indicated by an arrow D in FIG. 4, and the assembly illustrated in FIG. 2 can be utilized without any substantial modification.

Figure 5:
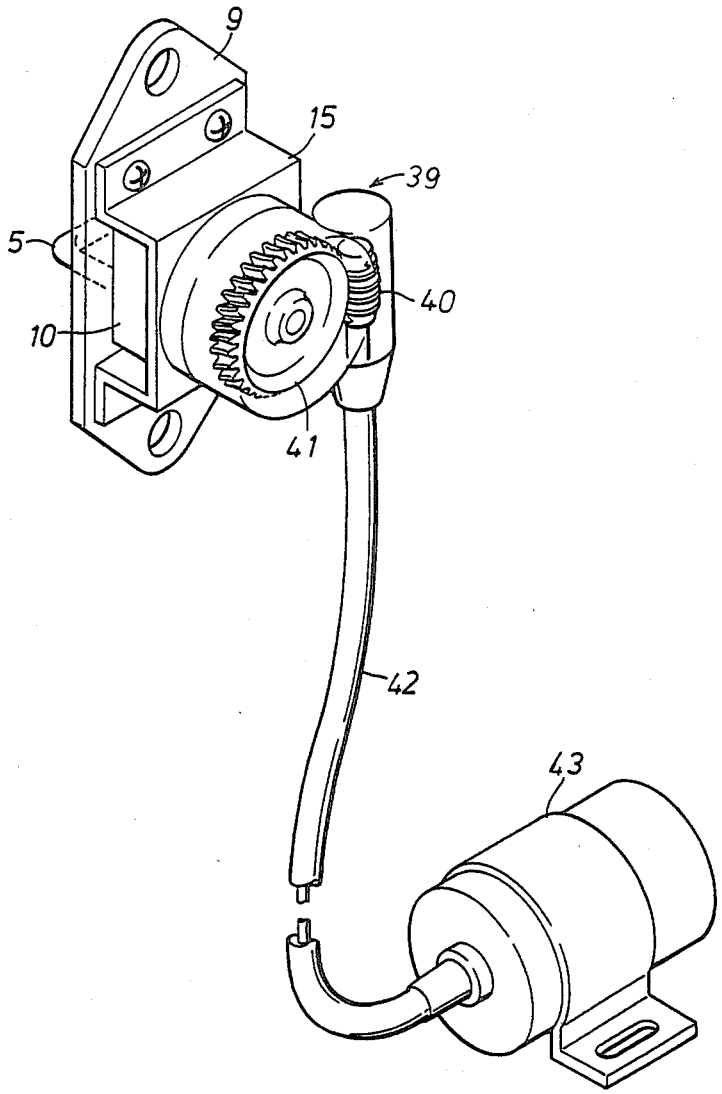
FIG. 5 is a schematic perspective view of a third embodiment of the present invention in which part of the drive means is placed remote from the striker means.

FIG. 5 shows a third embodiment of the present invention in which the means for driving the striker is different but other parts of the device may be identical to those in the previous embodiments. As shown in the drawing, a worm gear device 39, which is provided in place of the motor 16 in the previous embodiments, is internally incorporated with the worm gear 40 and a worm wheel 41. The input shaft of the worm gear 40 and the drive shaft of an electric motor 43 are mutually connected by a flexible wire 42, which comprises an inner wire and an outer tube and is adapted to transmit a twisting force, so that the rotative power of the electric motor 43 may be transmitted to the cam 11 by way of the worm gear 40 and the worm wheel 41.

Thus, according to the present invention, since the door can be fully latched before the weather strip is completely deformed, it is possible to close the door with only a very light force and the closing of the automotive door is simplified. And any incomplete closure of the door due to the reaction force of the weather strip is avoided and the improper closure of the door can be effectively eliminated.

Furthermore, since a cam is a power transmission means which does not tend to be reversely driven by an external force acting on the striker, there is almost no chance of malfunctioning of the device of the present invention due to any external force which may act on the door and a fail safe feature will be obtained even in case of a failure of the drive source. Additionally, since the worm reduction gear device is used and it is therefore possible to arrange the input shaft and the output shaft in an orthogonal relationship, it is possible to reduce the axial length of the rotary shaft of the cam to a very small value. Furthermore, by connecting the drive source with the input shaft of the worm reduction gear device by way of the flexible wire to drive the input shaft, the drive source may be placed in a relatively spacious area and a substantial effect in reducing design restrictions will be produced.

Furthermore, since the structure of the present invention is such a simple means for obtaining a reciprocating motion that a compact and economical device will be provided. In particular, if a cam having a plurality of cam lobes is used, a necessary stroke of the striker may be obtained by an accordingly smaller angular displacement of the cam. Additionally, since it is possible to determine the profile of the cam so that the outer circumference of the cam is always in contact with the lateral ends 11*b* of the cam follower, and the speed of action and the magnitude of active force can be freely determined, a smooth action without any play can be obtained and the feeling of the user will be improved.

Although the cam was heart-shaped in the above embodiment, the shape need not necessarily be of this shape. It is possible to determine the stroke and the speed of the action in a transient state by appropriately varying the profile of the cam. Also, the timing of the motion of the striker towards the external position may not be the moment of opening the door and various other modes of control are possible.

Further, the drive source for rotating the cam is not limited by the above-mentioned electric motor having the reduction gears and it may be even more effective, depending on the particular application, to use a linear hydraulic cylinder in combination with a rack and pinion gear device or a hydraulic rotative motor. And, it is also possible to cause the reciprocating motion of the striker by connecting it to a screw, links and levers, and the drive source may also be pneumatic or hydraulic.

Thus, according to the present invention, since the sensor means for controlling the action of the motor 16 for driving the striker consisted of the door switch 21 which had already been equipped to the vehicle for operating an interior light or the like, manufacturing steps and cost will not increase. Furthermore, since the action of the door and the action of the striker can be automatically synchronized, not only a great convenience is obtained but also chances of human errors are reduced in assuring secure latching of the door, whereby great advantages in useability and safety are obtained.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

We claim:

1. A striker means for automotive door latch assembly, comprising: a latch member mounted to a jamb surface of a door; and a striker member mounted to an opposing surface of a vehicle body, which opposes the jamb surface of the door when the door is closed, for engagement with the latch member, further comprising:

a guide means for guiding the striker member for motion along a closing direction of the door, and a drive means for driving the striker member along the closing direction of the door when the latch member has been engaged with the striker member, and the drive means comprising a drive source, a cam fixed to an output shaft of the drive source, a cam follower fixed to a base end of the striker member for cooperation with the cam.

2. A striker means for automotive door latch assembly as defined in claim 1, wherein the guide means comprises a horizontal slot provided in a base plate which is fixedly attached to the opposing surface of the vehicle body opposing the jamb surface of the door when the door is closed.

3. A striker means for automotive door latch assembly as defined in claim 1 or 2, wherein the opposing surface of the vehicle body is provided with an opening which is wide enough to accommodate at least a main part of the drive source, the cam and the cam follower, and is substantially covered by the base plate, whereby the base plate is interposed between a base end of the striker member and the periphery of the opening of the opposing surface of the vehicle body.

4. A striker means for automotive door latch assembly as defined in claim 3, wherein a seal member is interposed between the base end of the striker member and a surface of the base plate opposing the base end of the striker member.

5. A striker means for automotive door latch assembly as defined in claim 4, wherein the cam follower consists of a planar member having substantially perpendicular walls on either lateral end thereof, defining a space for accommodating the cam therebetween.

6. A striker means for automotive door latch assembly as defined in claim 5, wherein the cam is heart-shaped by combining a pair of oval cams by their diametral lines so as to have a pair of cam lobes which are angularly spaced from each other by 90 degrees.

7. A striker means for automotive door latch assembly as defined in claim 3, wherein the door is a sliding door.

8. A striker means for automotive door latch assembly as defined in claim 3, wherein the drive means comprises a motor and a reduction gear device which is integral with the motor.

9. A striker means for automotive door latch assembly as defined in claim 8, wherein the reduction gear device comprises a worm gear and a worm gear wheel.

10. A striker means for automotive door latch assembly as defined in claim 1, 2, further comprising a control means which activates the drive means in the door closing direction when the striker member is latched with the latch member.

11. A striker means for automotive door latch assembly as defined in claim 10, further comprising a door switch for detecting the position of the door at which the striker member latches with the latch member.

12. A striker means for automotive door latch assembly as defined in claim 11, wherein the control means comprises a timer for delaying the activation of the drive means from the time the latching of the door is detected by the door switch.

13. A striker means for automotive door latch assembly as defined in claim 11 or 12, wherein the door switch also controls a room lamp of the vehicle.

14. A striker means for automotive door latch assembly as defined in claim 10, wherein the door is a sliding door.

15. A striker means for automotive door latch assembly as defined in claim 10, wherein the opposing surface of the vehicle body is provided with an opening which is wide enough to accomodate at least a main part of the drive source, the cam and the cam follower, and is substantially covered by the base plate, whereby the base plate is interposed between a base end of the striker member and the periphery of the opening of the opposing surface of the vehicle body.

16. A striker means for automotive door latch assembly as defined in claim 15, further comprising a door switch for detecting the position of the door at which the striker member latches with the latch member.

17. A striker means for automotive door latch assembly as defined in claim 16, wherein the control means comprises a timer for delaying the activation of the drive means from the time the latching of the door is detected by the door switch.

18. A striker means for automotive door latch assembly as defined in claim 17, wherein the door switch also controls a room lamp of the vehicle.

19. A striker means for automotive door latch assembly as defined in claim 10, wherein the drive means comprises a motor, a reduction gear device which is integral with a striker assembly, and a flexible means which connects the reduction gear device with an output shaft of the motor.

20. A striker means for automotive door latch assembly as defined in claims 1, 2, 5, 6, 7, 9 or 10, wherein the drive means comprises a motor and a reduction gear device which is integral with the motor.

21. A striker means for automotive door latch assembly as defined in claim 20.

22. A striker means for automotive door latch assembly as defined in claim 20, wherein the reduction gear device comprises a worm gear and a worm gear wheel.

23. A striker means for automotive door latch assembly as defined in any one of claims 1, 2, 5, 6, 7, 9, 10 or 14, wherein the door is a sliding door.

24. A striker means for automotive door latch assembly as defined in claim 1, 2, 5, 6, 7, 9 or 10, wherein the drive means comprises a motor, a reduction gear device which is integral with a striker assembly, and a flexible means which connects the reduction gear device with an output shaft of the motor.

* * * * *